US009599295B2

(12) United States Patent
Delano

(10) Patent No.: US 9,599,295 B2
(45) Date of Patent: Mar. 21, 2017

(54) LIGHT FIXTURE WITH ARTICULATED JUNCTION BOX

(71) Applicant: Howard D. Delano, Kingston, NY (US)

(72) Inventor: Howard D. Delano, Kingston, NY (US)

(73) Assignee: USAI, LLC, New Windsor, NY (US)

( * ) Notice: Subject to any disclaimer, the term of this patent is extended or adjusted under 35 U.S.C. 154(b) by 38 days.

(21) Appl. No.: 14/491,535

(22) Filed: Sep. 19, 2014

(65) Prior Publication Data

US 2015/0078012 A1 Mar. 19, 2015

Related U.S. Application Data

(60) Provisional application No. 61/879,898, filed on Sep. 19, 2013.

(51) Int. Cl.

| | |
|---|---|
| ***F21V 15/00*** | (2015.01) |
| ***F21S 8/02*** | (2006.01) |
| ***F21V 21/30*** | (2006.01) |
| ***F21V 23/02*** | (2006.01) |

(52) U.S. Cl.

CPC ..... *F21S 8/02* (2013.01); *F21S 8/026* (2013.01); *F21V 21/30* (2013.01); *F21V 23/023* (2013.01); *F21V 23/026* (2013.01)

(58) Field of Classification Search

CPC F21S 8/02; F21S 8/026; F21V 23/023; F21V 23/268; F21V 21/26–21/30; H02G 3/08–3/088

USPC ..... 362/365; 248/342–344, 276.1, 278.1, 248/282.1, 289.11, 289.31

See application file for complete search history.

(56) References Cited

U.S. PATENT DOCUMENTS

| | | | | |
|---|---|---|---|---|
| 7,878,471 | B2 * | 2/2011 | Unsworth | F16M 11/10 248/278.1 |
| 8,727,583 | B2 * | 5/2014 | Russo | F21V 21/04 362/364 |
| 2010/0110698 | A1 * | 5/2010 | Harwood | F21V 21/30 362/365 |

OTHER PUBLICATIONS

Lucifer Lighting Company 2013(c) luciferlighting.com Apr. 15, 2013 pp. 6.

* cited by examiner

*Primary Examiner* — Laura Tso
*Assistant Examiner* — Naomi M Wolford
(74) *Attorney, Agent, or Firm* — St. Onge Steward Johnston & Reens LLC

(57) ABSTRACT

A light fixture has a mount to attach the light fixture to a support structure. A yoke is connected to the mount and is operable to rotate relative to the mount at least 360 degrees about a rotation axis passing through an illumination aperture of the light fixture. A lamp is connected to the yoke and is operable to rotate with the yoke about the rotation axis. A proximal end of a junction box is connected to the yoke and is operable to rotate at least 360 degrees relative to the yoke about the rotation axis, to maintain a rotational orientation of the junction box relative to the mount during rotation of the yoke and lamp. The junction box is operable to pivot relative to the yoke, about a pivot axis perpendicular to the rotation axis and to contact the support structure on a distal free end portion.

14 Claims, 17 Drawing Sheets

LIGHT FIXTURE WITH ARTICULATED JUNCTION BOX

FIELD OF THE INVENTION

The invention pertains to the field of light fixtures, and in particular to recessed light fixtures.

BACKGROUND OF THE INVENTION

In light fixtures, and in particular in recessed light fixtures, it is often desirable to provide for rotation and tilting of the lamp relative to the support structure to which the light fixture is attached, to permit aiming of the light emitted by the light fixture. Such light fixtures often include a junction box to house electrical components and to interconnect such components with a power source, such as an electrical line. Due to the typical required size and weight of the junction box it is often desirable to separate the junction box from the remainder of the light fixture. However, wiring must necessarily interconnect the junction box and the lamp, and in prior devices such wiring can inhibit or prevent rotation of lamp.

Therefore, what is desired is a light fixture suitable as a recessed light fixture, with a junction box which does not inhibit or prevent rotation of the lamp.

SUMMARY OF THE INVENTION

In an embodiment, the light fixture has an illumination aperture, a mount operable to attach the light fixture to a support structure, a yoke connected to the mount which is operable to rotate relative to the mount at least 360 degrees about a rotation axis passing through the illumination aperture. A lamp is connected to the yoke and is operable to rotate with the yoke about the rotation axis, and to emit light through the illumination aperture. A junction box for interconnecting the light fixture to a power source has a proximal end and a distal free end opposite the proximal end, and the junction box is rigid between the proximal end and the distal free end. The junction box is connected to the yoke by the proximal end and is operable to rotate at least 360 degrees relative to the yoke about the rotation axis, and to maintain a rotational orientation relative to the mount during rotation of the yoke at least 360 degrees relative to the mount about the rotation axis. The junction box is also operable to pivot relative to the yoke, about a pivot axis perpendicular to the rotation axis.

A rotating support is connected to the yoke and is operable to rotate at least 360 degrees about the rotation axis relative to the yoke. The proximal end of the junction box is connected to the rotating support by a pivotal connection defining the pivot axis.

The yoke has a first wire opening and the rotating support has a second wire opening, and the first and second wire openings are aligned and form a wire passage. The rotation axis passes through the wire passage, and an electrical conductor passing from the lamp, through the wire passage, to the junction box.

The rotating support comprises a disc having a first side and a second side opposite the first side, and having a circular outer periphery with a radially-outwardly facing circumferential surface. The first side of the disc abuts the yoke radially outwardly from the first wire opening. First retaining portions abut radially opposed portions of the circumferential surface of the disc and are operable to restrain the disc against radial movement perpendicular to the rotation axis. Second retaining portions abut the second side of the disc radially outwardly from the second wire opening, and are operable to restrain the disc against axial movement parallel to the rotation axis.

The first retaining portions comprise a first pair of retaining plates affixed to the yoke and abutting radially opposed portions of the circumferential surface of the disc. Each of the first pair of retaining plates have a concave edge complementary to and aligned closely adjacent the circumferential surface of the disc. The second retaining portions comprise a second pair of retaining plates, and each of the second pair of retaining plates are affixed to one of the first pair of retaining plates, and extend over and abutting the second surface of the disc.

The mount has a collar defining a circular illumination aperture, and the yoke has a base connected to the collar and operable to rotate at least 360 degrees about the rotation axis relative to the collar. The yoke has a pair of opposed arms or side portions connected to radially opposed sides of the base and has a top portion or cross member interconnecting the side portions. The lamp is connected to the side portions of the yoke, and the rotating support is connected to the top portion of the yoke; and the first wire opening is disposed in the top portion of the yoke.

In another embodiment of the invention, the light fixture includes a wire guide having a proximal end connected to the yoke, and the wire guide is operable to rotate at least 360 degrees relative to the yoke about the rotation axis, and is operable to maintain a rotational orientation relative to the mount during rotation of the yoke at least 360 degrees relative to the mount about the rotation axis. The wire guide is operable to pivot relative to the yoke, about a pivot axis perpendicular to the rotation axis. A rotating support is connected to the yoke, and the rotating support is operable to rotate at least 360 degrees about the rotation axis relative to the yoke. A proximal end of the wire guide is connected to the rotating support by a pivotal connection defining the pivot axis. The yoke has a first wire opening and the rotating support having a second wire opening, and the first and second wire openings are aligned and form a wire passage, and the rotation axis passing through the wire passage. An electrical conductor passes from the lamp, through the wire passage, to the wire guide.

DETAILED DESCRIPTION OF THE INVENTION

Figure 1A:
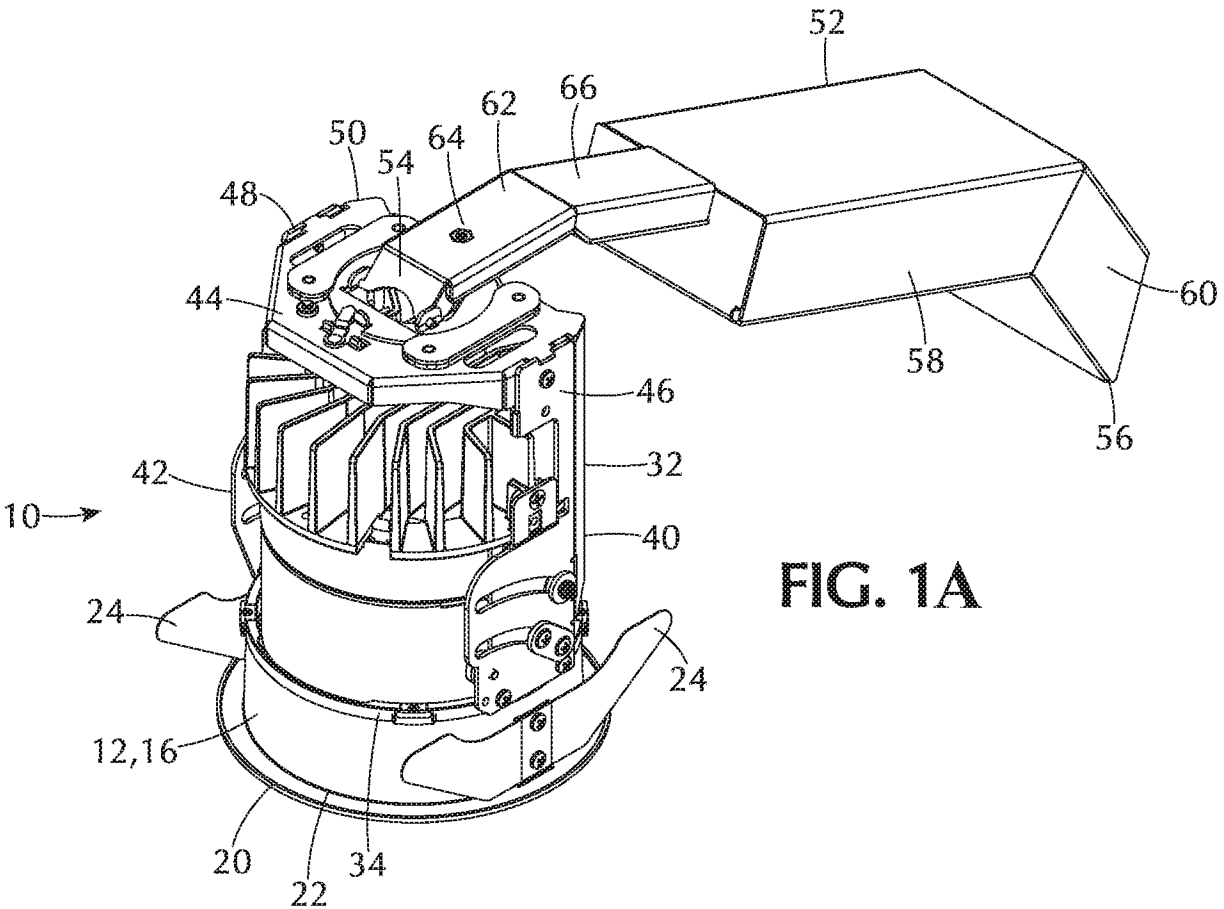
FIG. 1A is a perspective view of a light fixture according to a first embodiment of the invention.
Figure 1B:
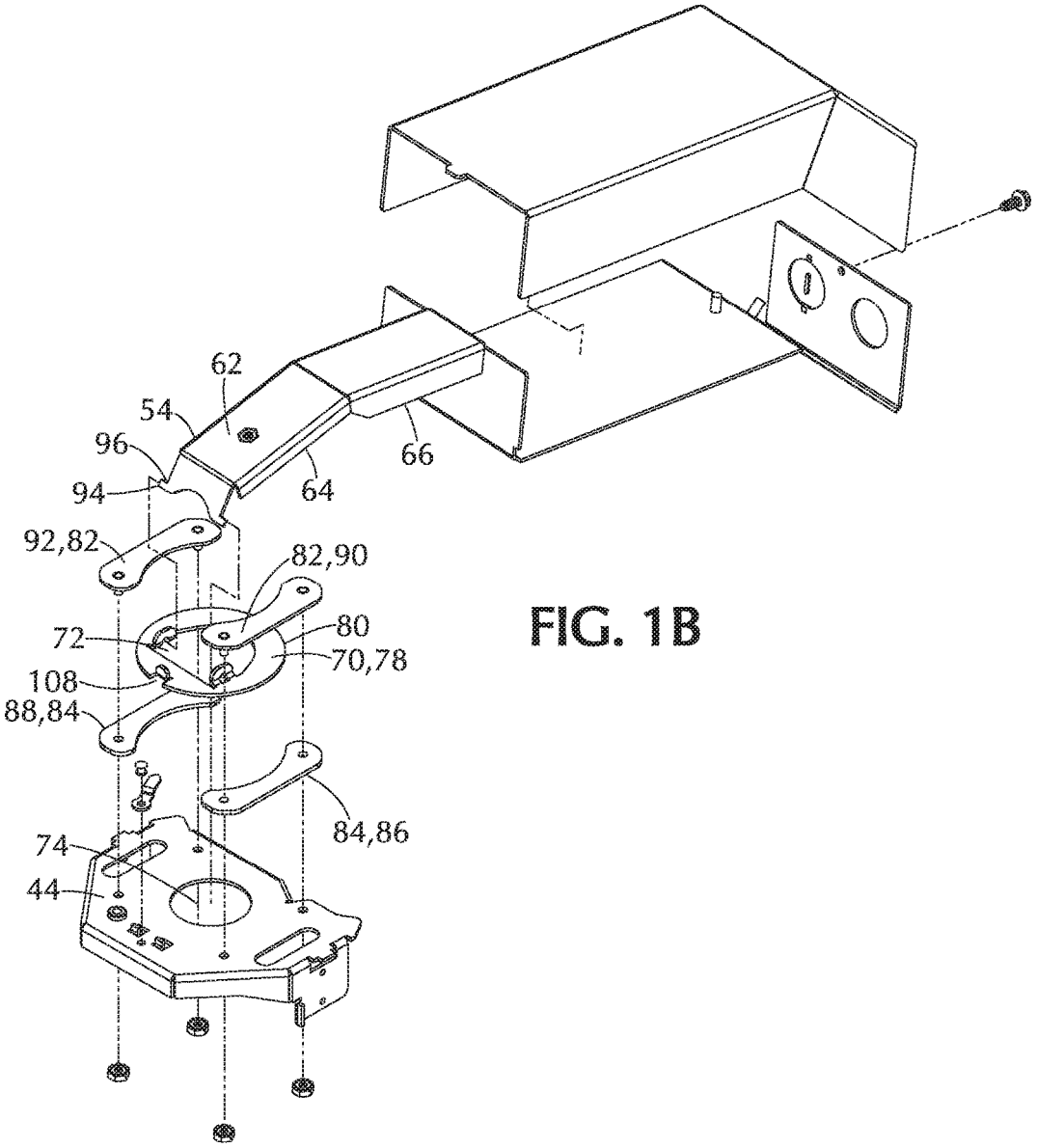
FIG. 1B is an exploded view of the light fixture of FIG. 1.
Figure 1C:
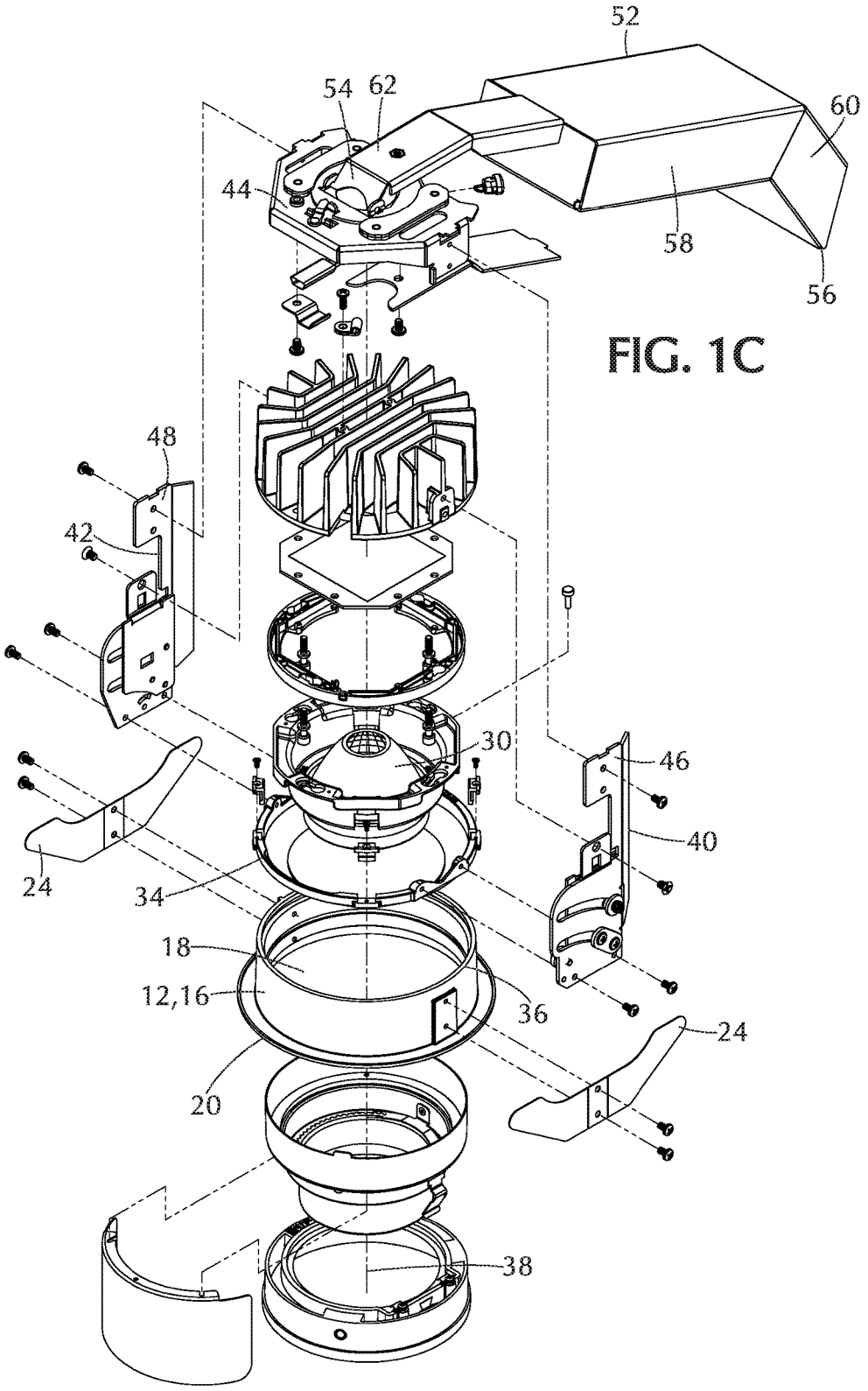
FIG. 1C an exploded view of a sub-assembly of the light fixture of FIG. 1.
Figure 2:
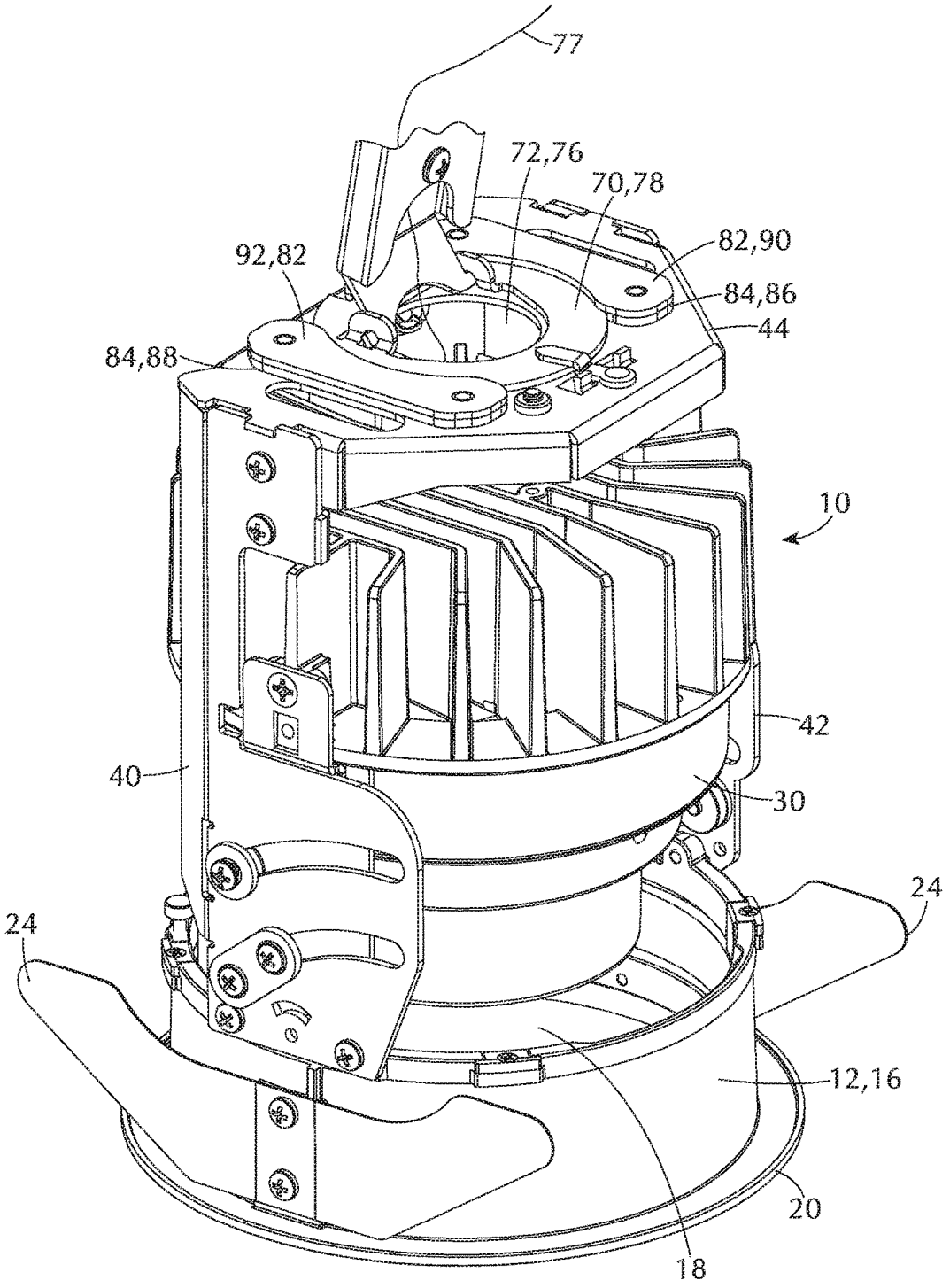
FIGS. 2 and 3 are a close-up perspective views of the light fixture of FIG. 1.

The light fixture is applicable for recessed lighting applications requiring lamp assemblies which rotate (and optionally tilt) to allow aiming of the light toward a desired location. The light fixture is particularly applicable for remodel or retrofit installations wherein the light fixture is installed through a hole in a finished support structure, such as a drywall ceiling or wall, or other "hard lid" surface. However, the light fixture is also suitable for other applications such as new construction installations. The light fixture provides an articulated junction box which, after installation, can remain stationary relative to the support structure without interfering with the rotation of the lamp to allow free alignment and adjustment of the lamp, preferably in any desired rotation orientation. The junction box can also pivot relative to the lamp to facilitate installation and removal of the light fixture from the support structure and such that the junction box partially rests on the support structure.

Referring to FIGS. 1-15, a first embodiment of the light fixture 10 includes a mount 12 (e.g., a trim) operable to mount the light fixture 10 to the support structure 14. The mount 12 has a cylindrical collar 16 defining an illumination aperture 18 and has an annular flange 20 extending radially outwardly from a bottom end 22 of the collar 16. Spring portions 24 are disposed on opposed sides of the collar 16 for attaching the mount and the light fixture to the support structure 14. When the light fixture 10 is installed in a properly sized hole 26 in the support structure 14, the flange 20 of the collar 16 contacts an exterior (i.e., room-facing) surface 28 of the support structure 14 around and adjacent a periphery of the hole 26 and the spring portions 24 contact an interior surface 29 of the support structure 14 around the periphery of the hole 26 opposite the flange 20, and the flange and spring portions 24 cooperate to affix the light fixture 10 to the support structure 14 such that the mount 12 is substantially immobile. As depicted, the mount can be in the form of a "trim" element, however, alternative mounting structures are also applicable, such as hanger bars or other suitable mounting structures and methods.

The light fixture 10 has a lamp 30 operable to emit light through the illumination aperture 18. The lamp 30 includes an illumination element (i.e., a lamp), and optionally other components such as a heat sink and optical elements (e.g., lenses, diffusers, etc.).

The light fixture 10 has a yoke 32 for supporting the lamp 30 adjacent the illumination aperture 18 while allowing the lamp 30 to rotate (and optionally tilt) relative to the mount 12 and support structure 14 to aim the light. The yoke 32 has a base 34 rotatably connected to the mount 12, preferably at a top 36 of the collar 16. The base 34 is operable to rotate at least 360 degrees relative to the mount 12, about a rotation axis 38 passing through the illumination aperture 18 (preferably perpendicularly through a center of the aperture). The rotation axis 38 is preferably aligned with or substantially parallel to a longitudinal axis of the collar 16 which can also be an optical axis of the light fixture when the lamp is not tilted, i.e., when the lamp is aimed straight through the illumination aperture 18. The yoke 32 preferably has a pair of arms 40, 42 affixed to and extending from opposed sides of the base 34 of the yoke. The arms 40, 42 extend away from the base 34 substantially parallel to the rotation axis 38. A cross member 44 of the yoke 32 interconnects free ends 46, 48 of the arms 40, 42 opposite the mount 12, forming a frame 50. The arms 40, 42 and cross member 44 are fixed relative to and rotate with the base 34 of the yoke 32 about the rotation axis 38 relative to the mount 12.

Figure 5:
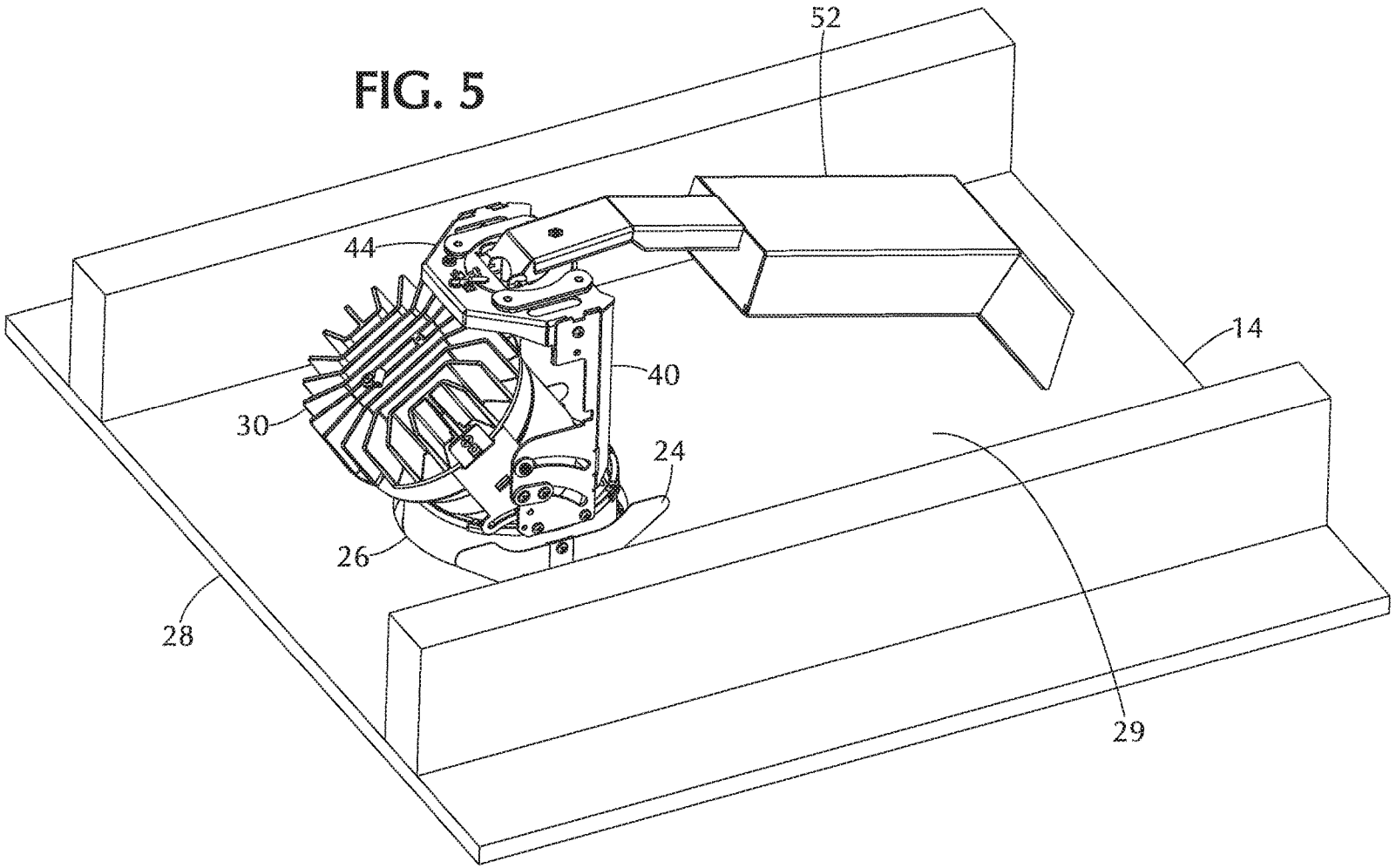
FIGS. 5-8 are perspective views of the light fixture of FIG. 1, showing the light fixture attached to a support structure and the lamp in four rotational positions.
Figure 6:
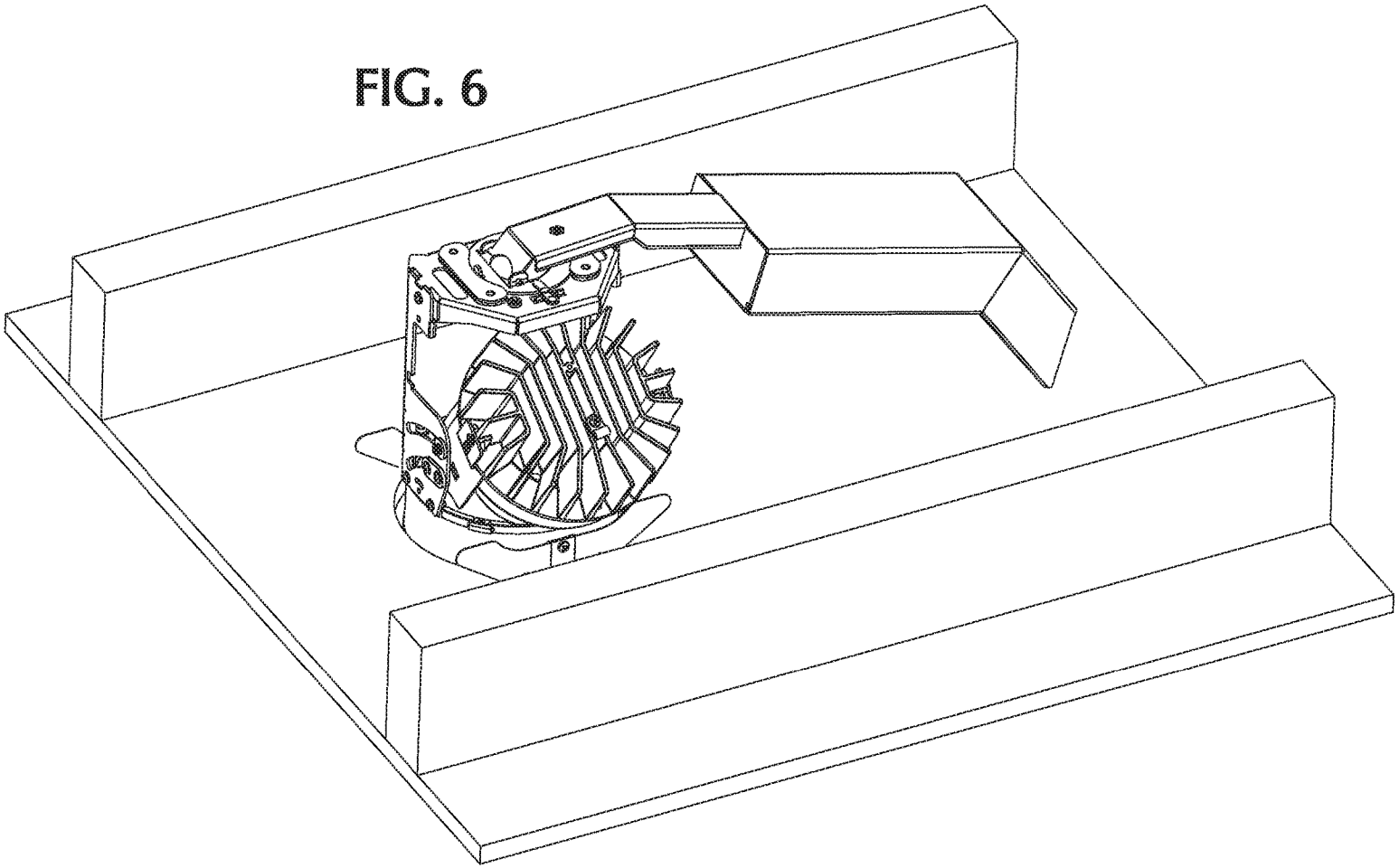
Figure 7:
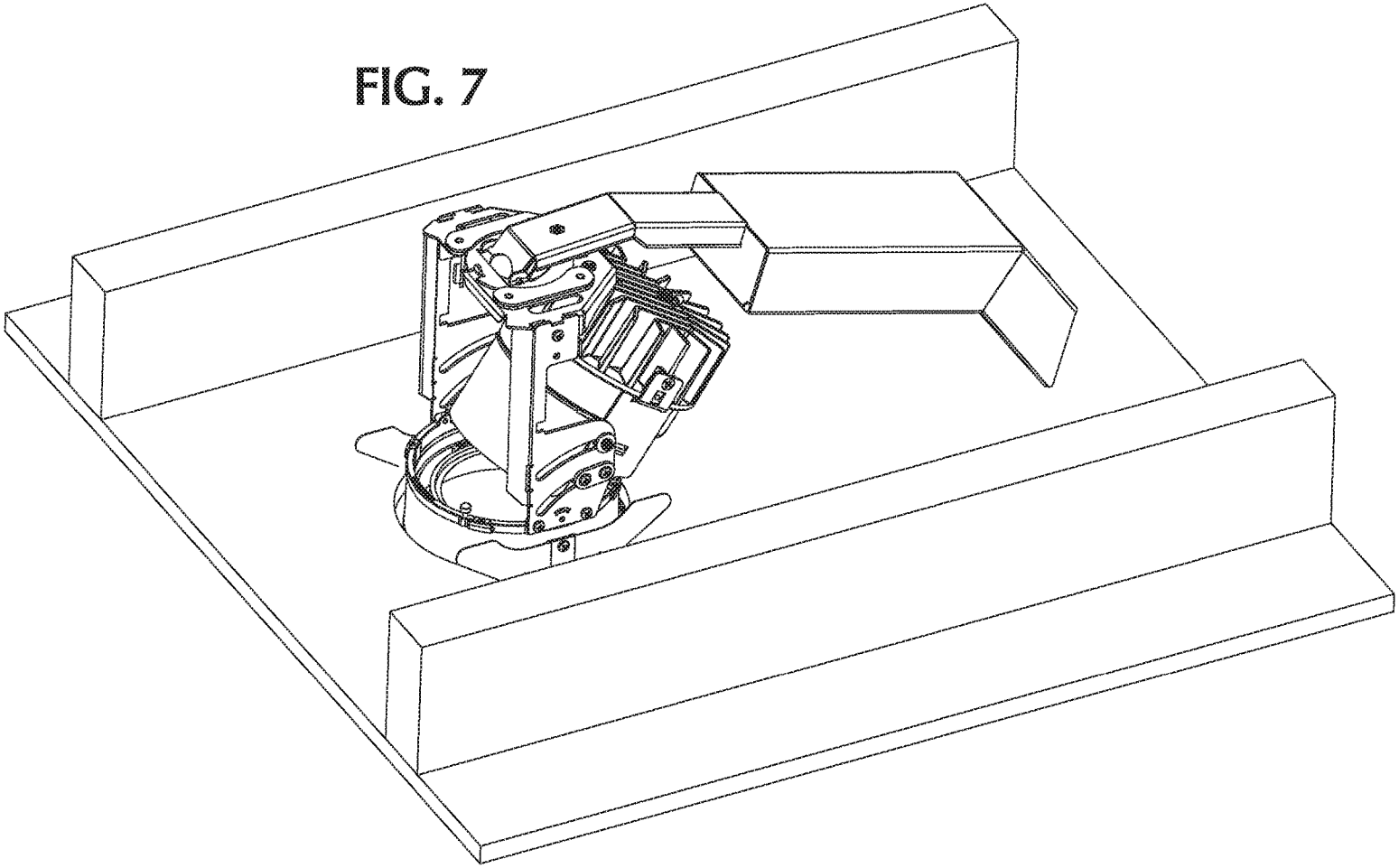
Figure 8:
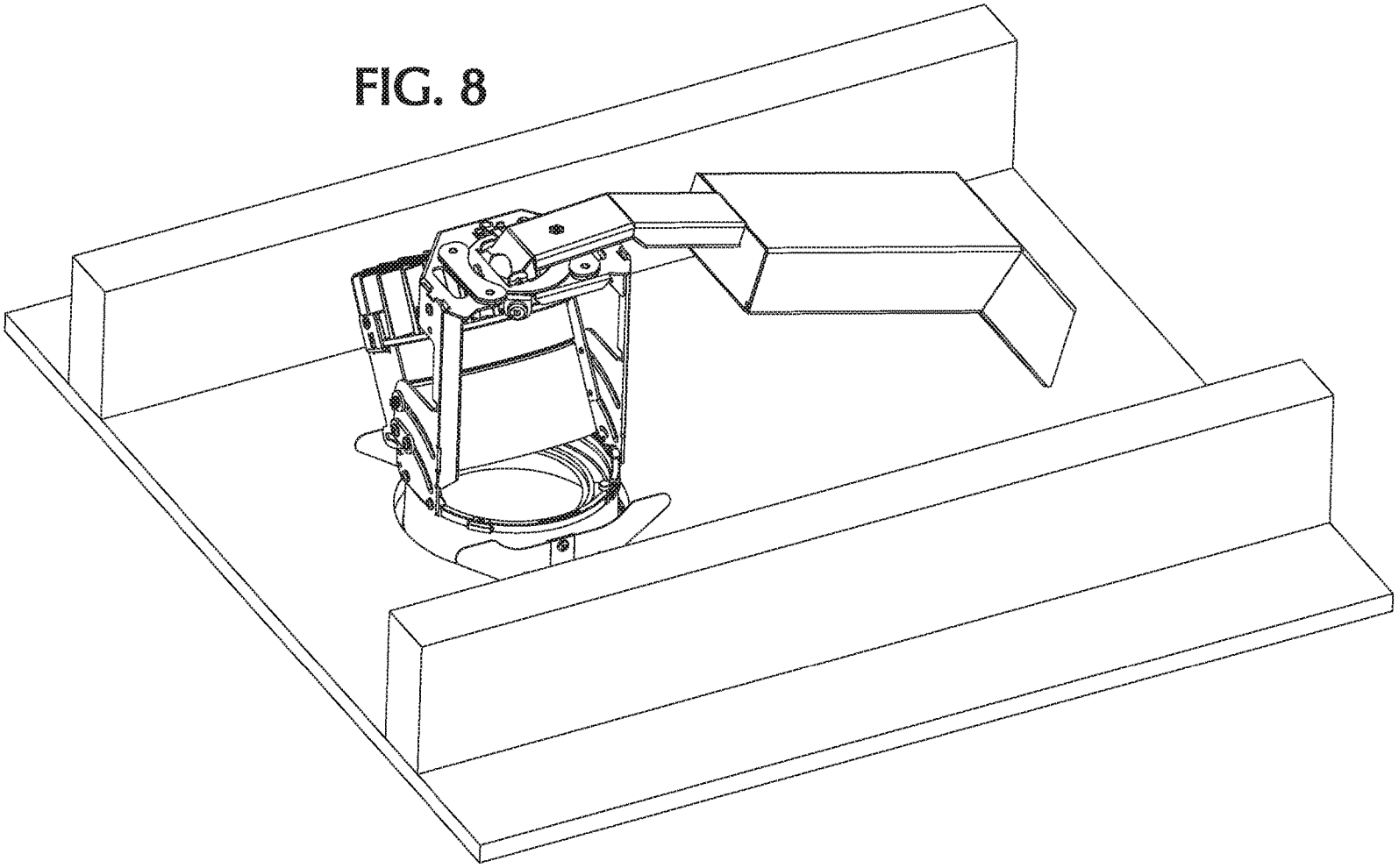
Figure 9:
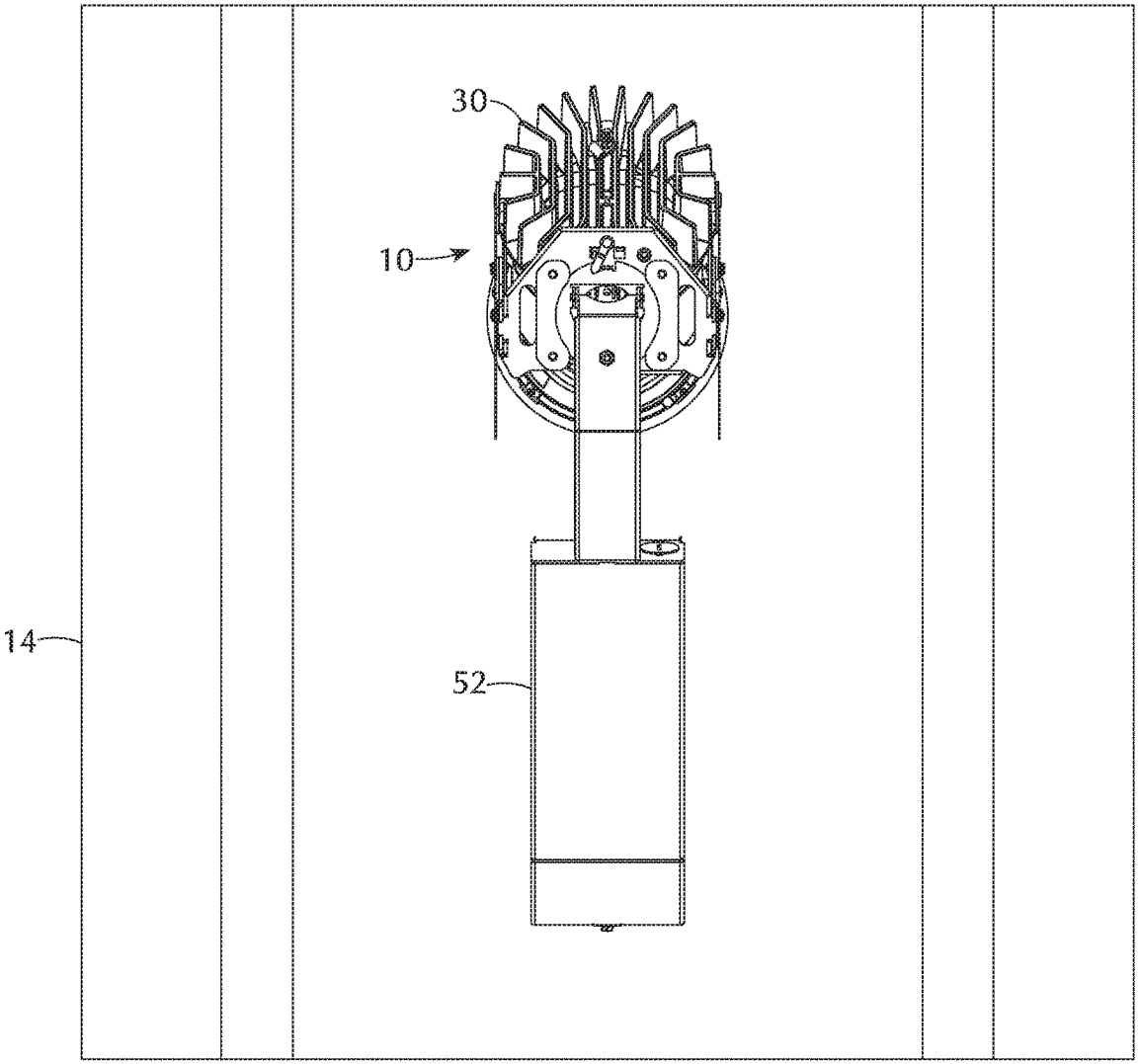
FIGS. 9-12 are top plan views of the light fixture of FIG. 1, showing the light fixture of FIG. 1 and the lamp in the four rotational positions depicted in FIGS. 5-8.
Figure 10:
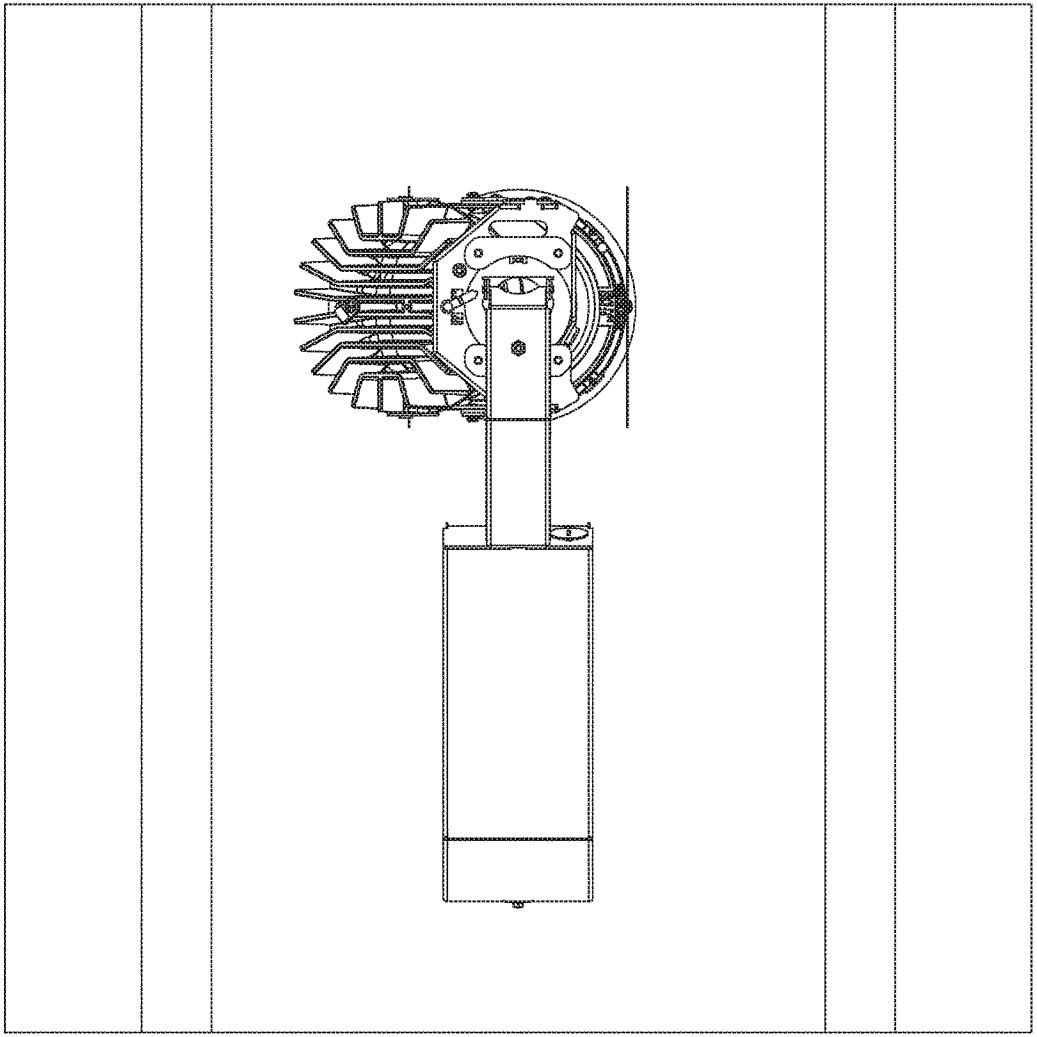
Figure 11:
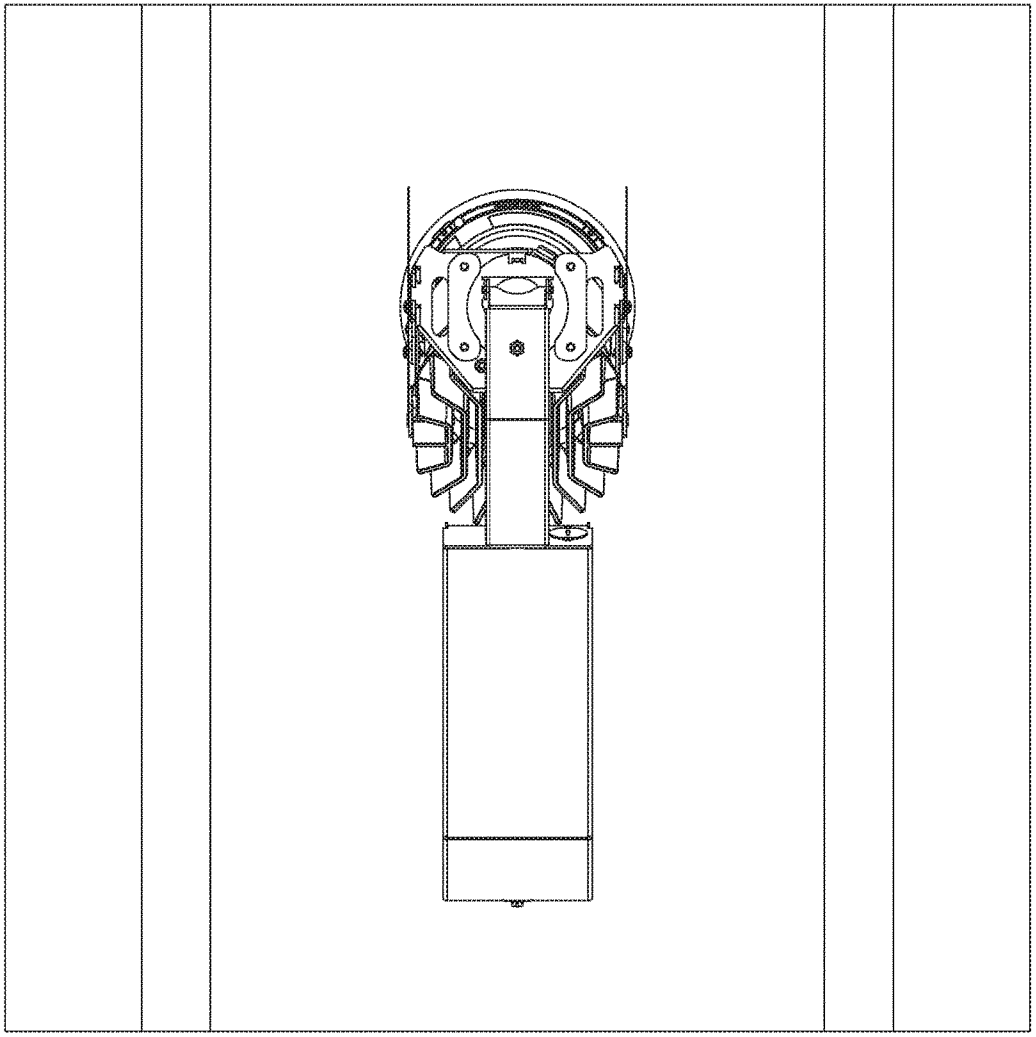
Figure 12:
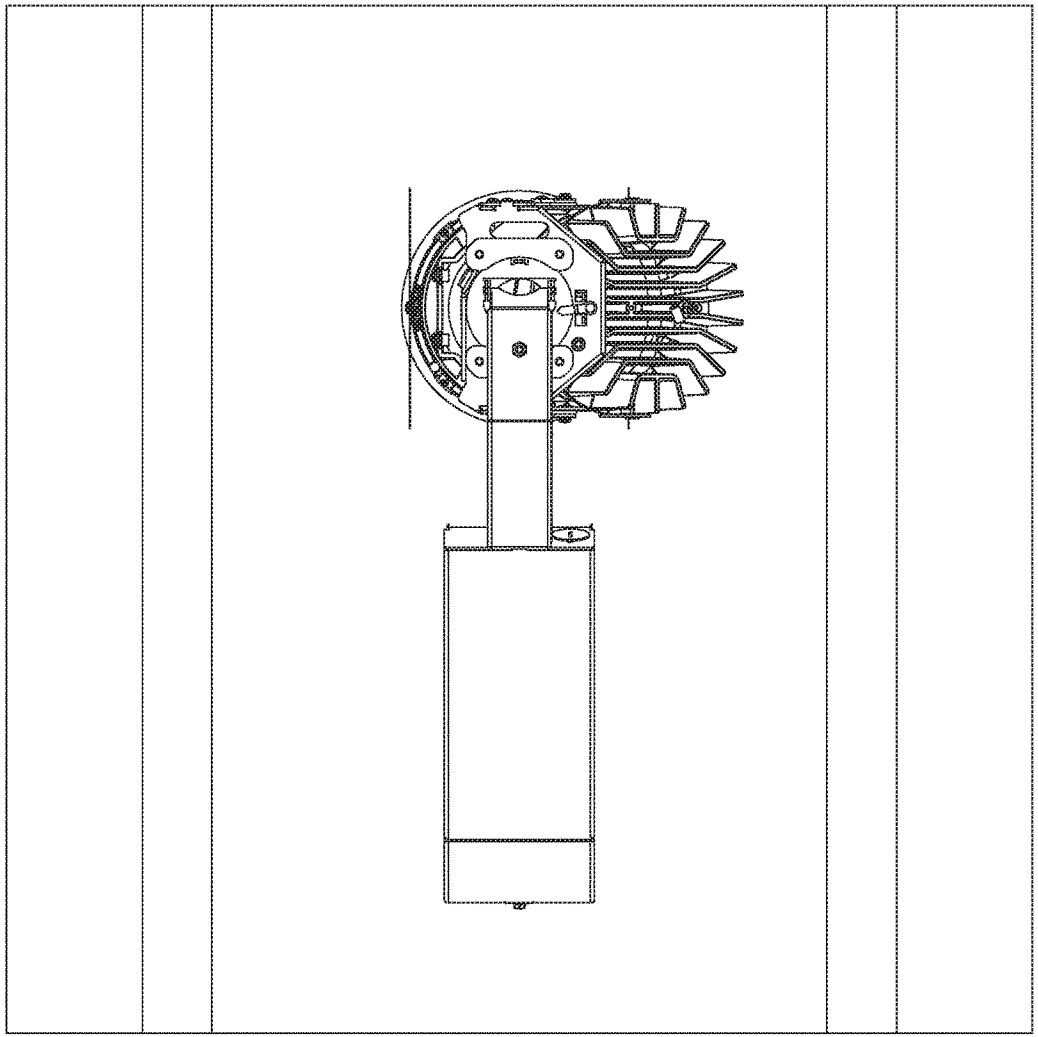
Figure 13:
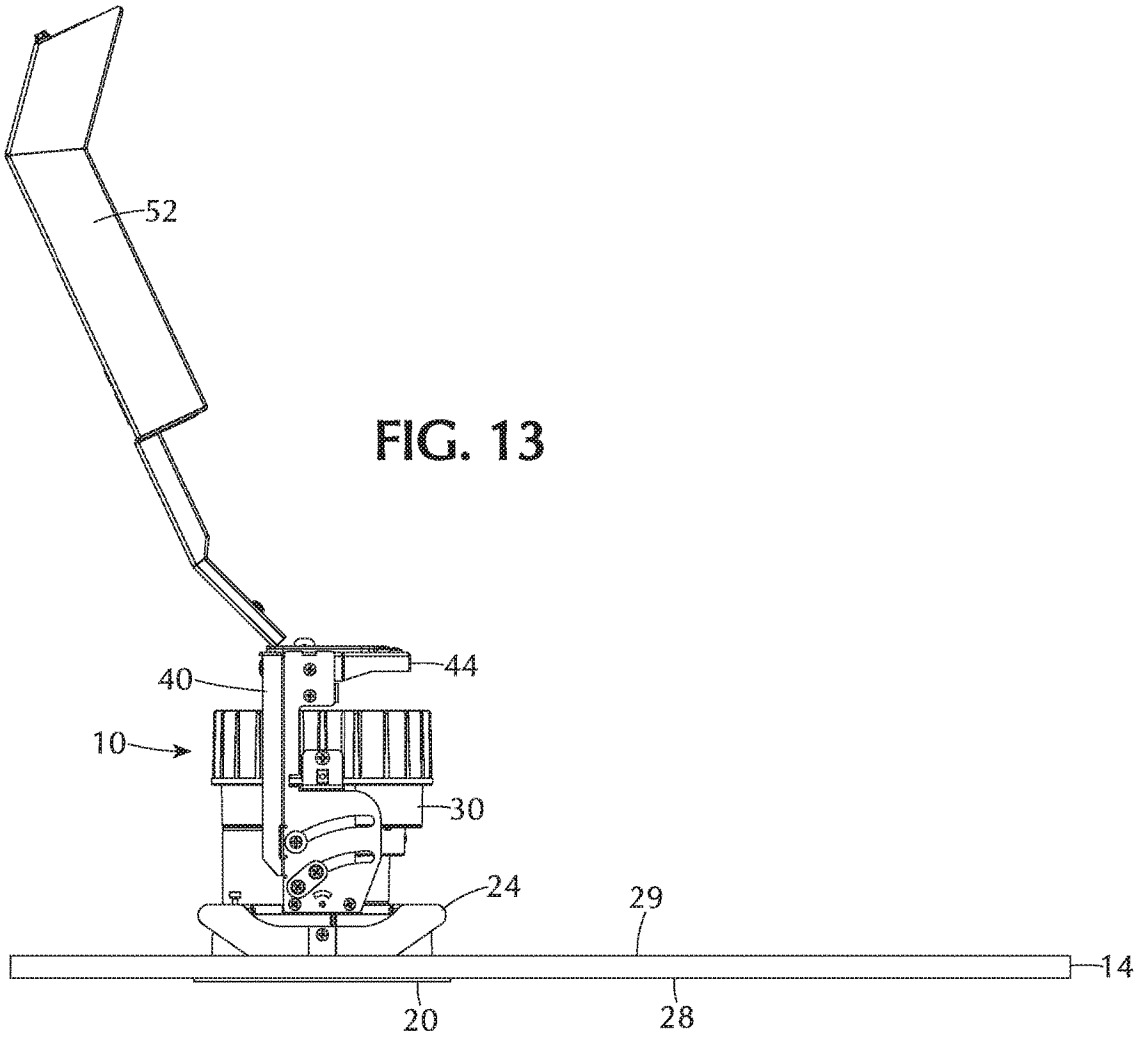
FIG. 13 is an elevation view of the light fixture of FIG. 1, showing the junction box in an installation position.
Figure 14:
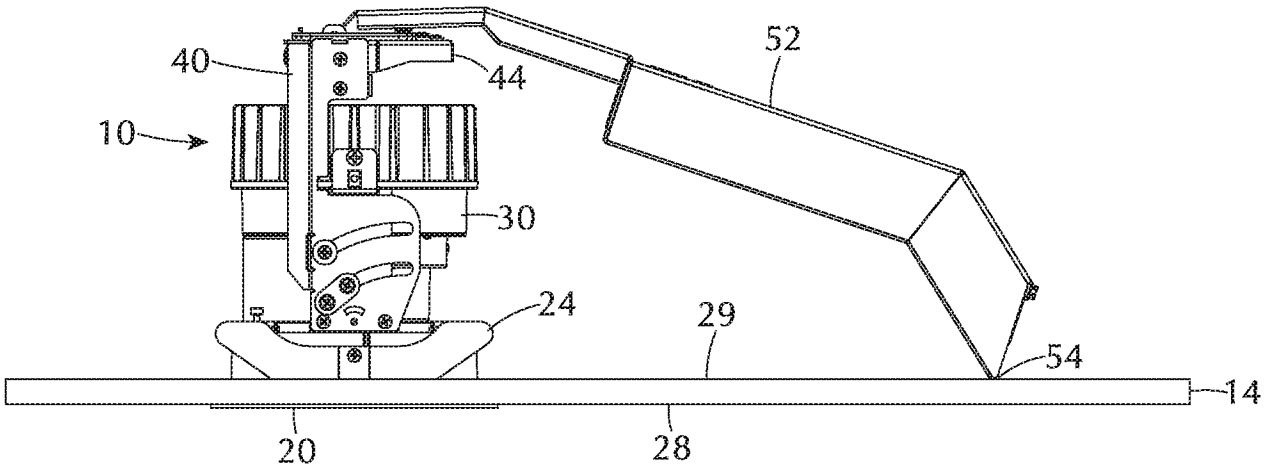
FIG. 14 is an elevation view of the light fixture of FIG. 1, showing the junction box in an operation position.

The lamp 30 is mounted to the yoke 32, and preferably to the arms 40, 42 of the yoke 32, between the cross member 44 and the base 34. The lamp 30 is operable to rotate with the yoke 32 at least 360 degrees about the rotation axis 38 relative to the mount 12. The lamp 30 is preferably movably mounted to the arms 40, 42 of the yoke 32 such that the lamp 30 can translate relative to the mount 12 and/or tilt (e.g., 0 to 35 or 45 degrees, or more) relative to the yoke 32 about a tilt axis different than the rotation axis 38. For example, as depicted in FIG. 5, the lamp 30 is in a maximal tilted orientation (e.g., 30-40 degrees from the rotation axis 38).

The light fixture 10 includes a junction box 52 for connecting the light fixture 10 to a power source. The junction box 52 has a proximal end 54 and a distal free end 56 opposite the proximal end 54 and the junction box is rigid between the proximal end and distal free end. The junction box 52 has an enclosure 58 in a intermediate portion for housing an electrical component such as driver or ballast or other component. A connection compartment 60 is disposed adjacent the distal free end 56 for interconnecting the electrical component to wiring from the power source, and a wire guide 62 is disposed adjacent the proximal end 54 for guiding wires from the electrical component to the lamp 30. The junction box 52, including the enclosure 58, connection compartment 60, and wire guide 62 preferably form a rigid, integral, unitary assembly.

The wire guide 62 of the junction box 52 can have first and second portions 64, 66 which are aligned at an obtuse angle, in a (side) elevation view. The enclosure 58 is preferably connected to, and aligned parallel with, the second portion 66 of the wire guide 62. The connection compartment 60 is connected to the enclosure 58 and is aligned at an obtuse angle with respect to the enclosure 58.

The light fixture 10 has a rotating support 70 connecting the proximal end 54 of the junction box 52 to the yoke 32 to allow the junction box 52 to rotate relative to the yoke 32. The rotating support 70 is operable to rotate at least 360 degrees about the rotation axis 38 relative to the yoke 32, and the junction box 52 is operable to rotate with the rotating support 70 at least 360 degrees about the rotation axis 38 relative to the yoke 32.

Referring to FIGS. 5-12, the rotating support 70 allows the junction box 52 to remain stationary relative to the mount 12 (and support structure 14) during rotation of the lamp 30 such that the rotating support 70 and junction box 52 can remain in one rotational orientation relative to the mount 12 during at least 360 degrees of rotation of the yoke 32 relative to the mount 12. The junction box 52, and in particular the wire guide 62, is configured to provide clearance and allow free, unhindered rotation of the lamp 30 at least 360 degrees about the rotation axis, when the lamp 30 is in any tilt orientation, including in a maximum tilt orientation (as depicted) of, for example, 30-45 degrees or more from the rotation axis 38.

Referring again to FIGS. 1-4, the rotating support 70 has a wire opening 72 which is aligned with a wire opening 74 of the cross member 44 of the yoke 32 forming a wire passage 76 to permit wires 77 to pass from the lamp 30, through the cross member 44 and rotating support 70, to the wire guide 62. The wire passage 76 is preferably substantially centered on the rotation axis 38.

The rotating support 70 preferably comprises a disc 78 having the aforementioned wire opening 72 and having opposing sides and a circular outer periphery 80 with an outwardly-facing circumferential surface. The disc 78 is constrained such that its only substantial movement is rotation about the rotation axis 38, relative of the yoke 32. A lower side of the disc abuts a top of the cross member 44 of the yoke 32 radially outwardly from a periphery of the wire opening 72 in the cross member 44 of the yoke 32 and restrains the disc 78 against movement in an axial direction parallel to the rotation axis 38 toward the mount 12. Axial retaining portions 82 fixed to the cross member 44 of the yoke 32 extend over and abut an upper side of the disc 78, opposite the lower side, radially outwardly from the periphery of the wire opening 72 in the disc 78 and restrain the disc against any substantial movement in an opposite axial direction (i.e., away from the mount 12). Radial retaining portions 84 of the yoke 32 abut opposed portions of the circumferential surface of the disc 78 and restrain the disc against any substantial radial movement perpendicular to the rotation axis 38.

The radial retaining portions 84 can comprise a plurality of (e.g., a pair of two) radial retaining plates 86, 88 affixed to or integrally formed with the cross member 44 of the yoke 32 and abutting or closely surrounding at least a portion of the circumferential surface of the disc 78 to substantially restrain the disc in all radial directions perpendicular to the rotation axis 38. The radial retaining plates 86, 88 have a concave edge complementary and aligned closely adjacent the circumferential edge of the disc 78. The axial retaining portions 82 can comprise a plurality of (e.g., a pair of two) axial retaining plates 90, 92 affixed to or integrally formed with the radial retaining plates 86, 88 and extending radially inwardly over and abutting the upper side of the disc 78, such that the axial retaining plates 90, 92 and the cross member 44 of the yoke 32 substantially restrain the disc 78 in both axial directions parallel to the rotation axis 38.

In addition to rotation about the rotation axis 38, the junction box 52 is also operable to pivot relative to the rotating support 70 about a pivot axis different than (and preferably perpendicular to) the rotation axis 38. The proximal end 54 of the junction box 52 is pivotally connected to the rotating support 70 by a hinge which permits the junction box 52 to pivot relative to the rotating support 70 (as well as relative to the yoke 32, mount 12 and support structure 14). The pivot axis is located on or slightly above the upper surface of the rotating support 70 and the pivot axis is preferably aligned perpendicular to the rotation axis 38. Thus, when the light fixture 10 is installed, the pivot axis is substantially parallel to the external surface 28 of the support structure 14. Preferably, the junction box 52 can pivot relative to the rotating support 70 more than 90 degrees from an installation orientation (see FIG. 13) wherein the wire guide is aligned generally vertically or substantially parallel to the rotation axis 38, to an operation orientation (see FIG. 14) wherein the wire guide 62 is aligned substantially perpendicular to the rotation axis 38. As can be appreciated, the junction box 52 can be pivoted into the installation orientation to install the light fixture 10 through the hole 26 in the support structure 14. Upon installation in a ceiling support structure, the junction box 52 will pivot downward, by the force of gravity, into the operation orientation until the distal free end 56 contacts and rests on the interior surface 29 the support structure 14. During removal of the light fixture, the junction box 52 will naturally pivot toward the installation orientation to allow the removal of the light fixture 10 through the hole 26 in the support structure.

Referring again to FIGS. 1-3, the hinge comprises a pair of opposed hinge pins 94, 96 on or integrally formed in the proximal end 54 of the junction box 52, and an associated pair of hinge flanges 98,100 connected to the rotating support 70 which cooperate with the hinge pins 94, 96 to pivotally connect the junction box to the rotating support. The hinge pins 94, 96 extend laterally outwardly in opposing directions from the proximal end 54 of the junction box 52. Each hinge flange 98, 100 has a base portion 102 extending inwardly, parallel to a plane perpendicular to the rotation axis 38, from a periphery of the wire opening 72 of the rotating support 70, and has a U-shaped portion 104 extending parallel to the rotation axis 38 away from the yoke 32, from an inward end of the base portion 102. The base portion 102 has a slot aligned with the pivot axis and the U-shaped portion 104 has a closed-ended slot aligned perpendicular to the pivot axis and in communication with the slot of the associated base 102 of the hinge flange 98, 100. The slots of the base and U-shaped portions 102, 104 of the hinge flanges 98, 100 are sized and shaped to receive and pivotally confine an associated hinge pin 94, 96. The hinge flanges 98, 100 are located radially outwardly from the periphery of the wire opening 74 in the cross member 44 of the yoke 32, and the U-shaped portions 102 and the cross member 44 cooperate to trap the hinge pins 94, 96 and constrain the junction box 52 against any substantial movement perpendicular to the pivot axis. Side surfaces of the U-shaped portions 102 of the hinge flanges 98, 100 abut opposed sides of the proximal end 54 of the junction box 52 adjacent the hinge pins 94, 96 to constrain the junction box 52 against any substantial axial movement parallel to the pivot axis, in either direction.

Referring again to FIG. 1, if the hinge flanges 98, 100 are integrally formed with the rotating support 70 (or pre-assembled therewith), during assembly of the light fixture 10, the proximal end 54 of the junction box 52 is mounted to the rotating support 70 before the rotating support is mounted to the yoke 32. The wire opening 72 of the rotating support 70 is sized and shaped to facilitate assembly of the junction box 52 to the rotating support 70. Preferably, the wire opening 72 of the rotating support 70 has a dimension sufficiently large to permit the proximal end 54 of the junction box 52 (and the hinge pins thereon) to be inserted through the wire opening 72 during assembly of the light fixture 10. After insertion, the hinge pins 94, 96 are aligned with and inserted into the slot of the base 102 of an associated hinge flange 98, 100 and then into the slot of the associated U-shaped portion 104. Then, the sub-assembly of the junction box 52 and rotating support 70 is permanently (rotatably) connected to the yoke 32 by mounting the rotating support 70 to the cross member 44 of the yoke 32, for example via the aforementioned retaining plates.

Referring again to FIGS. 13-14, upon installation in a ceiling support structure, the junction box 52 pivots downward, by the force of gravity, into the operation orientation until the distal free end 56, and in particular a free end of the connection compartment 60 of the junction box 52, contacts and rests on the interior surface 29 of the support structure 14. In this position, a portion (and preferably a majority) of the weight of the junction box is borne by the support structure 14 and not by the yoke 32 or mount 12, particularly if the center of gravity of the junction box 52 (including the enclosed electrical component) is substantially closer to the distal free end 56 than the proximal end 54. Further, with the distal free end 56 of the junction box 52 resting on the interior surface 29 of the support structure 12, and the proximal end 54 being connected to the yoke 32 by a pivot connection, the portion of the weight of the junction box 52 born by the yoke 32 causes no undesirable tilting moment on the yoke or light fixture.

The junction box 52 is configured to permit free, unhindered rotation of the yoke 32 and lamp 30 after installation. Specifically, the junction box 52 is configured to provide clearance between the junction box 52 (and in particular the wire guide) and the yoke 32 when the light fixture 10 is installed. When the light fixture 10 is installed and the junction box 52 is in the operation orientation, with the distal free end 54 of the junction box 52 resting on the interior surface 29 of the support structure 14, the yoke 32 and the attached lamp 10 are clear to rotate at least 360 degrees relative to the mount 12 and support structure 14 without interference between the junction box 52 and the yoke 32, regardless of the tilt orientation of the lamp 30 relative to the rotation axis 38. In particular, when the light fixture 10 is installed, the flange 20 of the mount 12 will be in contact with the exterior (i.e., room-facing) surface 28 of the support structure 14 (e.g., drywall). Therefore, the distal free end 54 portion of the junction box 52 will be elevated, relative to the flange 20 of the mount 12 by an elevation amount at least equal to the thickness of the support structure. The expected minimum thickness of such support structures is at least about 0.5 inches. Therefore, the light fixture 10 and junction box 52 are preferably configured such that the junction box 52 can pivot downwardly (by the force of gravity) to a position where the distal free end portion 54 of the junction box 52 is elevated above the flange 20 of the mount 12 (or other equivalent structure) an elevation amount less than the expected minimum thickness of the support structure, for example less than about 0.5 inches, or at or below the elevation of the flange 20. Further, the light fixture 10 and junction box 52 are preferably configured such that at or above a predetermined minimum elevation amount of the distal free end 54 of the junction box 52 above the flange 20 of the mount 12 (for example at or above 0.5 inches), sufficient clearance will exist between the junction box 52 and the yoke 32 to provide unhindered rotation of the yoke 32 and lamp 10 at least 360 degrees about the rotation axis 38 relative to the mount 12.

Figure 3:
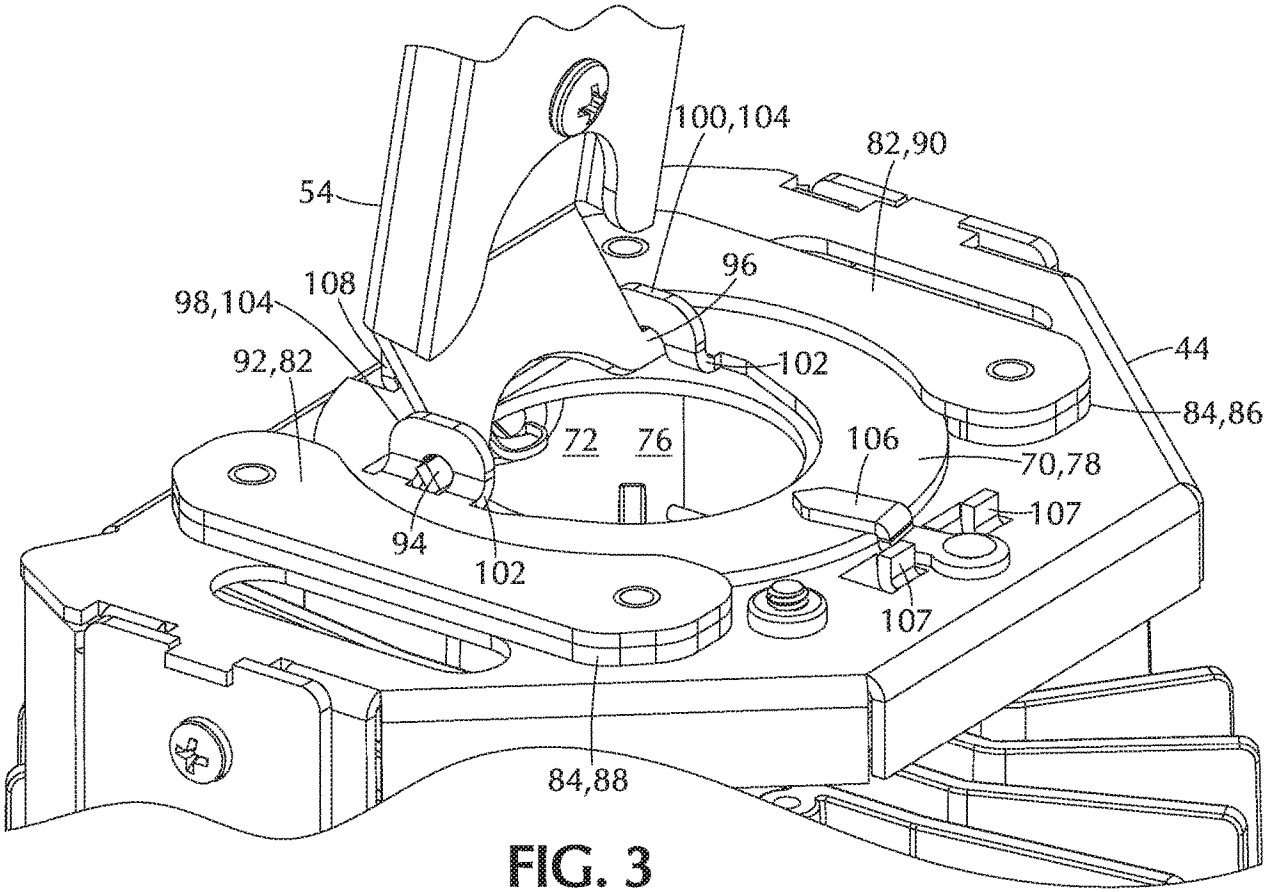
Figure 4B:
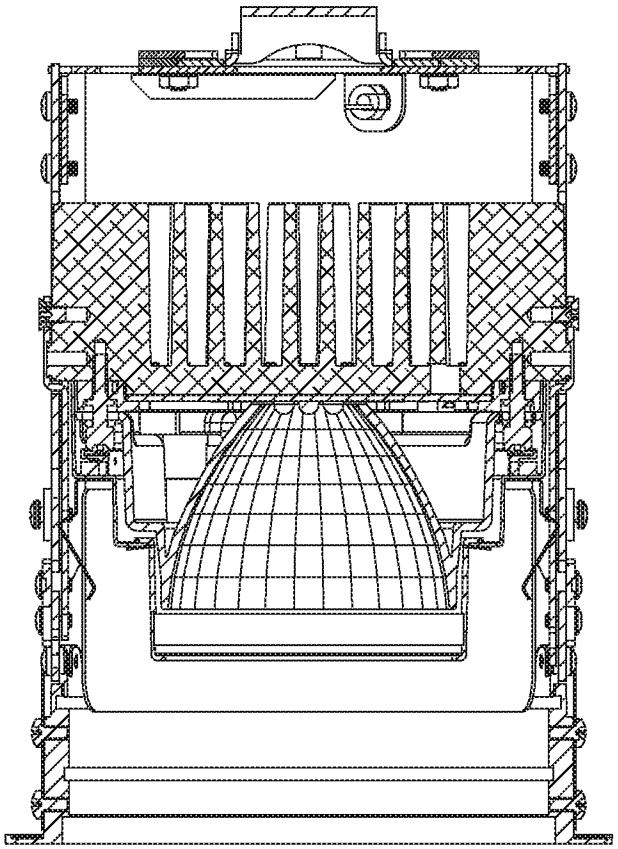
FIG. 4B is a cross section view of the light fixture of FIG. 1, taken along line A-A of FIG. 4A.
Figure 4A:
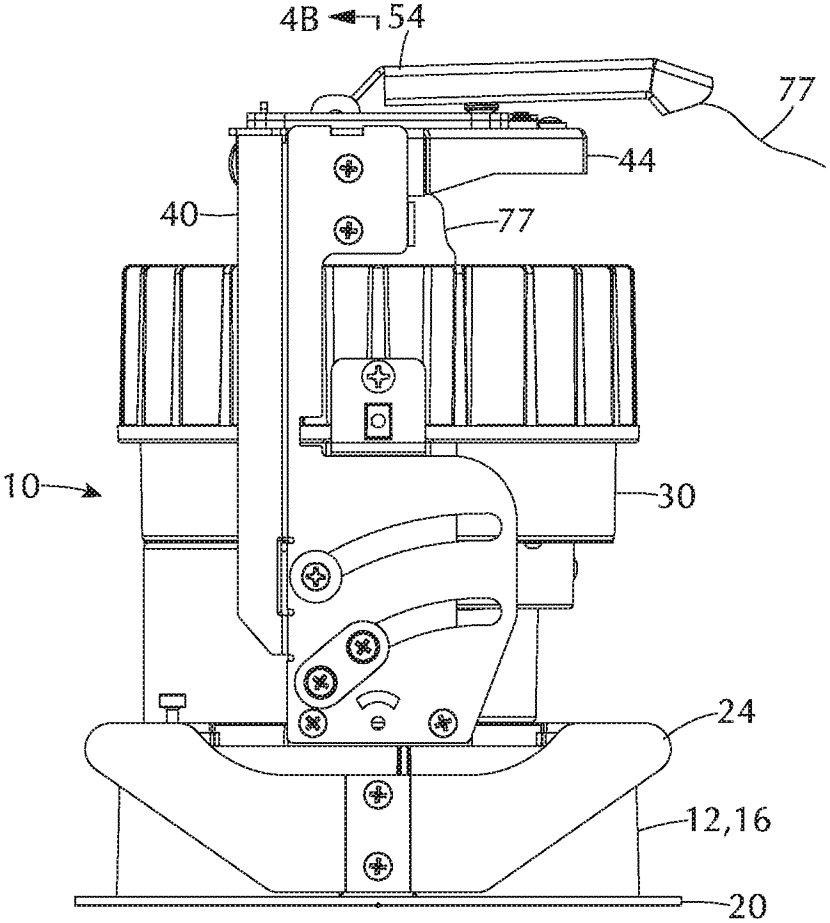
FIG. 4A is an elevation view of the light fixture of FIG. 1.

Referring to FIG. 3, the light fixture 10 preferably has a rotation limit to limit the rotation of the yoke 32 and lamp 30 relative to the junction box 52 to a predetermined amount of rotation greater than 360 degrees (e.g., 362 degrees) in either the clockwise or counterclockwise direction, to prevent undesired winding of electrical conductors. A stop arm 106 is pivotally connected to the cross member 44 of the yoke 32 radially outwardly from the outer periphery of the disc 78 and extends radially inwardly over the upper surface of the disc 78. The cross member 44 includes a pair of stop arm limit tabs 107 projecting upwardly on either side of the stop arm 106 to limit pivoting movement of the stop arm 106. The disc 78 includes a stop tab 108 projecting upwardly from the upper surface which contacts a free end of the stop arm 106 during rotation of the disc 78 relative to the yoke 32. The stop arm 106 pivots in two directions between the stop arm limit tabs 107 to allow the disc 78 to rotate only through the predetermined amount rotation in either the clockwise or counterclockwise direction.

Figure 15:
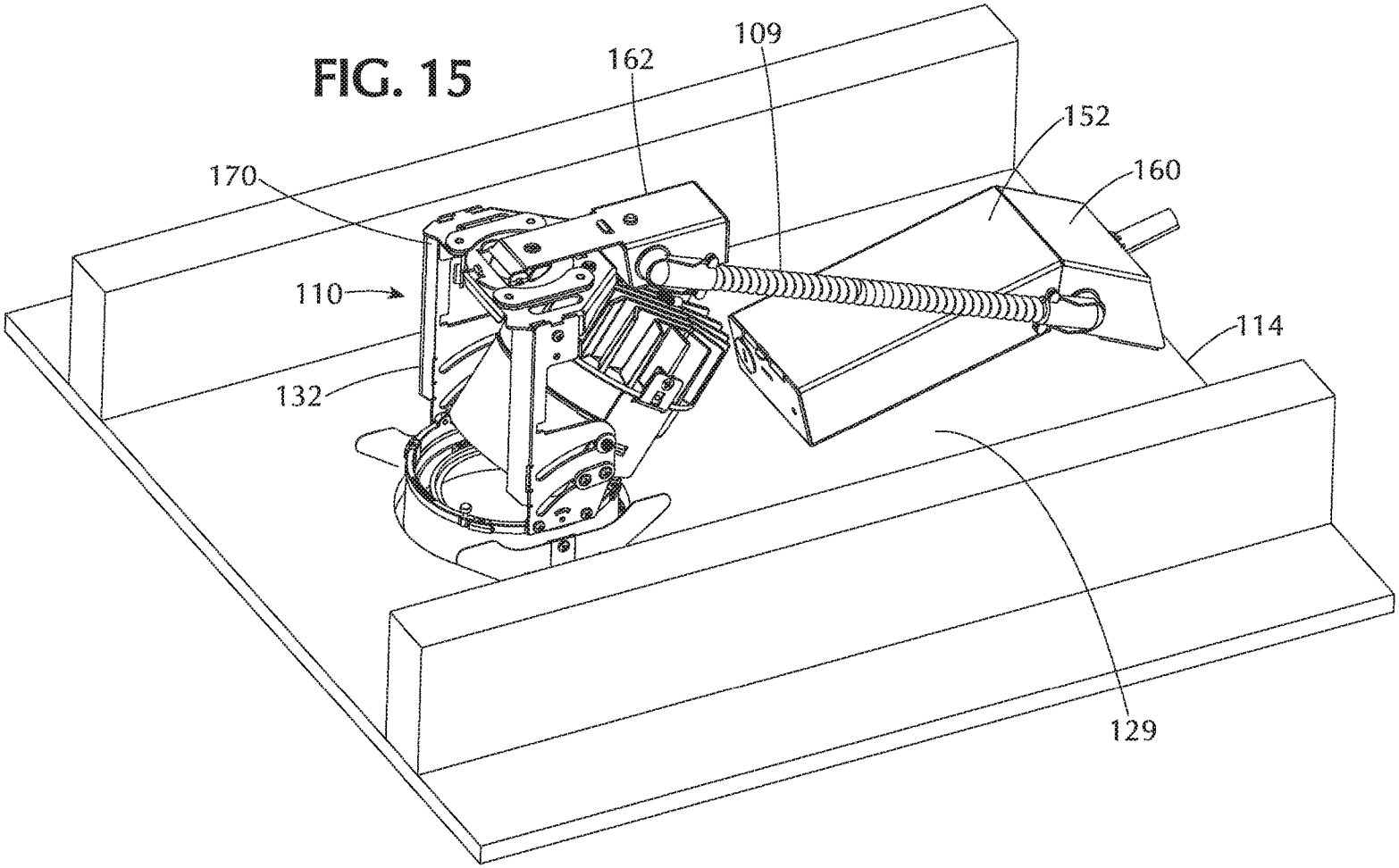
FIG. 15 is a perspective view of a second embodiment of a light fixture according to the invention.

Referring to FIG. 15, in another embodiment, the light fixture 110 has a structure as described above with respect to the first embodiment except that the wire guide 162 is connected to the junction box 152 and/or the connection compartment 160 via a flexible conduit 109. The flexible conduit 109 has a length sufficient to permit the junction box 152 to rest on the interior surface 129 of the support structure 114 when the light fixture 110 is mounted and the wire guide 162 is in the operation orientation. The rotating support 170 includes an operation position stop opposite the pivot axis relative to the wire passage of the rotating support 170. The operation position stop contacts the wire guide 162 when in the operation position to limit downward pivoting movement of the wire guide 162 to ensure sufficient clearance between the wire guide 162 and the yoke 132 during rotation of the yoke 132 and lamp 130 when the light fixture 110 is installed. The flexible conduit 109 is connected to the wire guide 162 at a location and in such a manner (for example at a sufficient distance from the rotation axis) such that the flexible conduit 109 does not interfere with rotation of the yoke 132 and lamp 130 when the light fixture is installed.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. A light fixture comprising:

an illumination aperture;

a mount operable to attach the light fixture to a support structure;

a yoke connected to the mount, the yoke being operable to rotate relative to the mount at least 360 degrees about a rotation axis passing through the illumination aperture;

a lamp connected to the yoke and operable to rotate with the yoke about the rotation axis, and the lamp being operable to emit light through the illumination aperture;

a junction box for interconnecting the light fixture to a power source;

the junction box having a proximal end and a distal free end opposite the proximal end, the junction box being rigid between the proximal end and the distal free end, and the proximal end of the junction box being connected to and supported by the yoke;

the junction box being operable to rotate at least 360 degrees relative to the yoke about the rotation axis, and the junction box being operable to maintain a rotational orientation relative to the mount during rotation of the yoke at least 360 degrees relative to the mount about the rotation axis; and the junction box being operable to pivot relative to the yoke, about a pivot axis perpendicular to the rotation axis.

2. The light fixture as in claim 1, further comprising:

a rotating support connected to the yoke, the rotating support being operable to rotate at least 360 degrees about the rotation axis relative to the yoke; and the proximal end of the junction box being connected to the rotating support by a pivotal connection defining the pivot axis.

3. The light fixture as in claim 2, further comprising:

the yoke having a first wire opening and the rotating support having a second wire opening;

the first and second wire openings being aligned and forming a wire passage, and the rotation axis passing through the wire passage; and an electrical conductor passing from the lamp, through the wire passage, to the junction box.

4. The light fixture as in claim 3, further comprising:

the rotating support comprising a disc having a first side and a second side opposite the first side, and having a circular outer periphery with a radially-outwardly facing circumferential surface;

the first side of the disc abutting the yoke radially outwardly from the first wire opening, first retaining portions abutting radially opposed portions of the circumferential surface of the disc and being operable to restrain the disc against radial movement perpendicular to the rotation axis; and second retaining portions abutting the second side of the disc radially outwardly from the second wire opening, and being operable to restrain the disc against axial movement parallel to the rotation axis.

5. The recessed light fixture of claim 4, further comprising:

the first retaining portions comprising a first pair of retaining plates affixed to the yoke and abutting radially opposed portions of the circumferential surface of the disc, each of the first pair of retaining plates having a concave edge complementary to and aligned closely adjacent the circumferential surface of the disc; and the second retaining portions comprising a second pair of retaining plates, each of the second pair of retaining plates being affixed to one of the first pair of retaining plates, and each of the second pair of retaining plates extending over and abutting the second surface of the disc.

6. The light fixture of claim 3, further comprising:

the mount having a collar defining a circular illumination aperture;

the yoke having a base connected to the collar of the mount and the base being operable to rotate at least 360 degrees about the rotation axis relative to the collar;

the yoke having a pair of opposed arms connected to radially opposed sides of the base and having a cross member interconnecting the arms;

the lamp being connected to the arms of the yoke;

the rotating support being connected to the cross member of the yoke; and the first wire opening being disposed in the cross member of the yoke.

7. A light fixture comprising:

an illumination aperture;

a mount operable to affix the light fixture to a support structure;

a yoke connected to the mount, the yoke being operable to rotate relative to the mount at least 360 degrees about a rotation axis passing through the illumination aperture;

a lamp connected to the yoke and operable to rotate with the yoke about the rotation axis, and the lamp being operable to emit light through the illumination aperture;

a wire guide having a proximal end connected to the yoke;

the wire guide being operable to rotate at least 360 degrees relative to the yoke about the rotation axis, and the being operable to maintain a rotational orientation relative to the mount during rotation of the yoke at least 360 degrees relative to the mount about the rotation axis;

the wire guide being operable to pivot relative to the yoke, about a pivot axis perpendicular to the rotation axis;

a rotating support connected to the yoke, the rotating support being operable to rotate at least 360 degrees about the rotation axis relative to the yoke;

the proximal end of the wire guide being connected to the rotating support by a pivotal connection defining the pivot axis;

the yoke having a first wire opening and the rotating support having a second wire opening;

the first and second wire openings being aligned and forming a wire passage, and the rotation axis passing through the wire passage;

an electrical conductor passing from the lamp, through the wire passage, to the wire guide;

the rotating support comprising a disc having a first side and a second side opposite the first side, and having a circular outer periphery with a radially-outwardly facing circumferential surface;

the first side of the disc abutting the yoke radially outwardly from the first wire opening, first retaining portions abutting radially opposed portions of the circumferential surface of the disc and being operable to restrain the disc against radial movement perpendicular to the rotation axis; and second retaining portions abutting the second side of the disc radially outwardly from the second wire opening, and being operable to restrain the disc against axial movement parallel to the rotation axis.

8. The recessed light fixture of claim 7, further comprising:

the first retaining portions comprising a first pair of retaining plates affixed to the yoke and abutting radially opposed portions of the circumferential surface of the disc, each of the first pair of retaining plates having a concave edge complementary to and aligned closely adjacent the circumferential surface of the disc; and the second retaining portions comprising a second pair of retaining plates, each of the second pair of retaining plates being affixed to one of the first pair of retaining plates, and each of the second pair of retaining plates extending over and abutting the second surface of the disc.

9. The light fixture of claim 8, further comprising:

the mount having a collar defining a circular illumination aperture;

the yoke having a base connected to the collar of the mount and the base being operable to rotate at least 360 degrees about the rotation axis relative to the collar;

the yoke having a pair of opposed arms connected to radially opposed sides of the base and having a cross member interconnecting the arms;

the lamp being connected to the arms of the yoke;

the rotating support being connected to the cross member of the yoke; and the first wire opening being disposed in the cross member of the yoke.

10. A light fixture comprising:

an illumination aperture;

a mount operable to attach the light fixture to a support structure;

a yoke connected to the mount, the yoke being operable to rotate relative to the mount at least 360 degrees about a rotation axis passing through the illumination aperture;

a lamp connected to the yoke and operable to rotate with the yoke about the rotation axis, and the lamp being operable to emit light through the illumination aperture;

a junction box for interconnecting the light fixture to a power source;

the junction box having a proximal end and a distal free end opposite the proximal end, the junction box being rigid between the proximal end and the distal free end, and the junction box being connected to the yoke by the proximal end;

the junction box being operable to rotate at least 360 degrees relative to the yoke about the rotation axis, and the junction box being operable to maintain a rotational orientation relative to the mount during rotation of the yoke at least 360 degrees relative to the mount about the rotation axis;

the junction box being operable to pivot relative to the yoke, about a pivot axis perpendicular to the rotation axis;

a rotating support connected to the yoke, the rotating support being operable to rotate at least 360 degrees about the rotation axis relative to the yoke; and the proximal end of the junction box being connected to the rotating support by a pivotal connection defining the pivot axis.

11. The light fixture as in claim 10, further comprising:

the yoke having a first wire opening and the rotating support having a second wire opening;

the first and second wire openings being aligned and forming a wire passage, and the rotation axis passing through the wire passage; and an electrical conductor passing from the lamp, through the wire passage, to the junction box.

12. The light fixture as in claim 11, further comprising:

the rotating support comprising a disc having a first side and a second side opposite the first side, and having a circular outer periphery with a radially-outwardly facing circumferential surface;

the first side of the disc abutting the yoke radially outwardly from the first wire opening, first retaining portions abutting radially opposed portions of the circumferential surface of the disc and being operable to restrain the disc against radial movement perpendicular to the rotation axis; and second retaining portions abutting the second side of the disc radially outwardly from the second wire opening, and being operable to restrain the disc against axial movement parallel to the rotation axis.

13. The recessed light fixture of claim 12, further comprising:

the first retaining portions comprising a first pair of retaining plates affixed to the yoke and abutting radially opposed portions of the circumferential surface of the disc, each of the first pair of retaining plates having a concave edge complementary to and aligned closely adjacent the circumferential surface of the disc; and the second retaining portions comprising a second pair of retaining plates, each of the second pair of retaining plates being affixed to one of the first pair of retaining plates, and each of the second pair of retaining plates extending over and abutting the second surface of the disc.

14. The light fixture of claim 11, further comprising:

the mount having a collar defining a circular illumination aperture;

the yoke having a base connected to the collar of the mount and the base being operable to rotate at least 360 degrees about the rotation axis relative to the collar;

the yoke having a pair of opposed arms connected to radially opposed sides of the base and having a cross member interconnecting the arms;

the lamp being connected to the arms of the yoke;

the rotating support being connected to the cross member of the yoke; and the first wire opening being disposed in the cross member of the yoke.

* * * * *